United States Patent [19]

Yamasaki et al.

[11] Patent Number: 4,724,462

[45] Date of Patent: Feb. 9, 1988

[54] COPYING MACHINE DISPLAY CONTROL DEVICE

[75] Inventors: Kimihito Yamasaki, Ikoma; Syoichiro Yoshiura, Yamatokoriyama, both of Japan

[73] Assignee: Sharp Kabushiki Kaisha, Osaka, Japan

[21] Appl. No.: 829,118

[22] Filed: Feb. 14, 1986

[30] Foreign Application Priority Data

Feb. 18, 1985 [JP] Japan ..... 60-30757

[51] Int. Cl.[4] ..... G03G 15/00

[52] U.S. Cl. ..... 355/14 R; 340/520; 340/715

[58] Field of Search ..... 355/14 R, 14 CU, 14 C; 340/700, 706, 713, 715, 718, 520, 524, 525; 364/518

[56] References Cited

U.S. PATENT DOCUMENTS

| | | | |
|---|---|---|---|
| 4,327,994 | 5/1982 | Barley et al. | 355/14 R |
| 4,343,547 | 8/1982 | Nagashima | 355/14 R |
| 4,403,850 | 9/1983 | Masuda | 355/14 R |
| 4,408,869 | 10/1983 | Tomosada et al. | 355/14 R |
| 4,427,288 | 1/1984 | Nagashima | 355/14 R |
| 4,475,806 | 10/1984 | Daughton et al. | 355/14 R |
| 4,598,994 | 7/1986 | Tomosada et al. | 355/14 R |

*Primary Examiner*—R. L. Moses

*Attorney, Agent, or Firm*—Birch, Stewart, Kolasch & Birch

[57] ABSTRACT

Disclosed is a display control device of a copying machine which is provided with a plurality of displays on the operational panel and warns operators of some abnormal condition present in the copying machine by lighting up a specific alarm display which corresponds to the content of the abnormal condition through activating a specific circuit for extinguishing all other displays.

3 Claims, 3 Drawing Figures

COPYING MACHINE DISPLAY CONTROL DEVICE

BACKGROUND OF THE INVENTION

The present invention relates to a control device for easier identification of an illuminated alarm that warns the operator of some abnormal condition in a copying machine.

Conventionally, copying machines are provided with a variety of additional functions and devices such as variable ratio copying, automatic document feeding, and sorting. These copying machines are provided with a number of display devices on the operation panel for indicating the operative conditions and modes of the copying machine. Display devices include indicators warning the operator of a shortage of copying paper, lack of toner, jammed papers, full toner collecting container full receiving tray, etc. Nevertheless, in many cases, these conventional copying machines cannot allow the operator to easily and quickly indentify the illuminated alarm display, because a variety of other displays (a paper counter, paper-size indicator, etc.) also remain illuminated even when a specific alarm display lamp lights up to warn the operator of some malfunction in the copying machine. As a result, if the operator starts the copying operation with automatic document feeding and is unaware of a paper shortage, and then leaves the machine, the machine remains inactive without performing the designated copying operation, thus resulting in wasted time.

SUMMARY OF THE INVENTION

The present invention aims at providing the copying machine with a display control device that enables the operator to easily identify an illuminated alarm display and eliminates the disadvantages mentioned above. The preferred embodiment of the present invention provides the copying machine with means for turning off all displays except the alarm display indicating an abnormal condition.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 2:
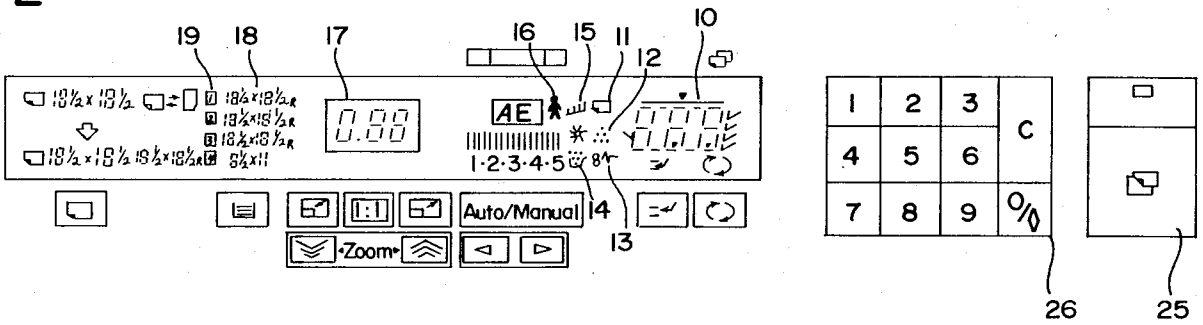
FIG. 2 is the configuration of the operation panel of a copying machine incorporating the display control device embodied by the present invention.

FIG. 2 is the configuration of the operation panel of a copying machine incorporating the display control device embodied by the present invention. The display panel 1 is provided with a copy number display 10, a paper required indicator 11, a toner required indicator 12, a paper misfeed indicator 13, a toner collecting container full indicator 14, a paper receiving tray full indicator 15, a maintenance required indicator 16, a copy ratio indicator 17, a cassette select indicator 18, and a cassette position indicator 19, respectively.

Figure 3:
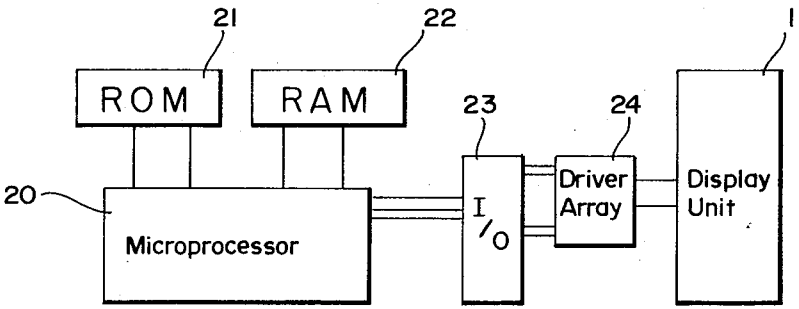
FIG. 3 is a simplified block diagram of the control device of a copying machine reflecting the preferred embodiment of the present invention.

The reference numerals 25 and 26 respectively indicate the print button and number keys for setting the number of copies to be made. The copy number display 10 and other peripheral indicators make up part of the lateral view of the copying machine incorporating the preferred embodiment of the present invention. Note that the copy number display 10 also functions as the indicator identifying the position where copy paper has jammed. FIG. 3 is a simplified block diagram of the control device of the copying machine. A microprocessor 20 is connected to a ROM 21 for storing various programs needed for controlling the operation of the copying machine, a RAM 22 for storing data related to the various operational modes, and to I/O port 23 that executes the input and output of various data between respective components of the copying machine. The I/O port 23 is connected to a driver array 24 which controls the illumination of the display unit 1 of the operation panel. The RAM 22 is provided with an alarm provision area D for storing a specific numerical value corresponding to the content of some abnormality in the copying machine.

Figure 1:
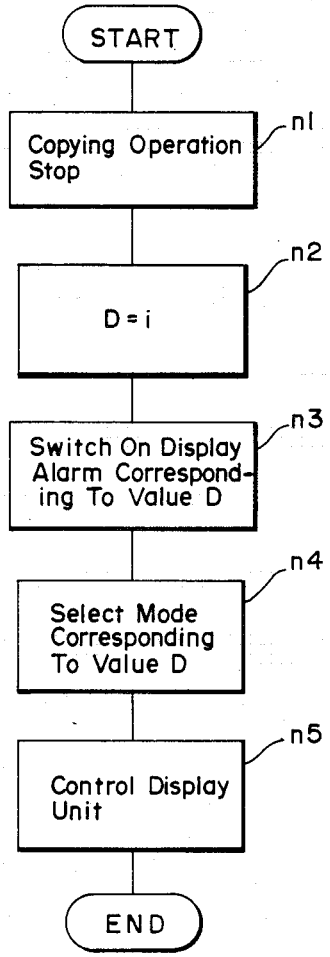
FIG. 1 is a flowchart describing the operation of the control device of a copying machine provided with the display control device reflecting the preferred embodiment of the present invention.

FIG. 1 is a flowchart describing the operations of the control device which illuminates alarm indicators when any abnormal condition arises. The microprocessor identifies some abnormal condition at step n1 and the machine stops its copying opreation. At step n2, a specific numerical value corresponding to the content of the abnormal condition is stored in the alarm provision area D. Value "1" is stored in area D when copy paper in the cassette has completely run out. Value "2" is stored when there is a lack of toner in both the developer unit and the toner bottle. Value "3" is stored when the copy paper jams. Value "4" is stored when the exhausted toner container is fully filled, and value "5" when the discharged papers fill the tray. When the mode enters step n3, a specific alarm indicator corresponding to the numerical value stored in D lights up. When value "1" is stored, the paper required indicator 11 lights up.

When value "2" is stored, the toner required indicator 12 lights up. When the value "3" is stored, the paper misfeed indicator 13 lights up. When value "4" is stored, the toner collecting container full indicator 14 lights up. When value "5" is stored, the paper receiving tray full indicator 15 lights up. At step n4, a specific mode for controlling the display unit corresponding to a specific value in area D is activated. While the display unit control mode remains activated, the system executes the following functions.

When value "1" is stored in area D, all the indicators are turned off except for the paper required indicator 11, the cassette position indicator 19 indicating the position of the paper-feeding tray that has run out of the paper during the copying operation, and the cassette select indicator 18. When value "2" is stored, all the indicators are turned off except for the toner required indicator 12 and the copy number display 10 which indicates the number of copies remaining to be made. When value "3" is in area D, the paper-jammed position is indicated by the designated copy number display 10 in addition to the paper misfeed indicator 13. If the copying operation is still underway, the copy number display 10 alternately indicates the remaining number of papers designated for copying and the position where the copy paper is jammed. Other indicators are all turned off. When value "1" is in D, all the indicators are turned off except for the toner collecting container full indicator 14. When value "5" is stored in area D, all the indicators are turned off except for the paper receiving tray full indicator 15 and the cassette select indicator 18 which indicates the size of copying paper in the cassettes. At step n5, the operations are completed after executing the designated display control mode during step n4. Actually, steps n4 and n5 respectively execute means for turning off unnecessary displays, which make up the essence of the present invention.

As is clear from the foregoing description, according to the preferred embodiment of the present invention, when any abnormal condition is present in the copying machine, the control device reflecting the present invention correctly lights up the relevant alarm display that deals with the abnormal condition of the copying machine. In addition, since all indicators are turned off except those giving the operator information needed for either releasing the interrupted state or for resuming the copying operation after releasing the interrupted state, the operator can easily identify the activated alarm display unit as well as the content of the abnormal condition. Furthermore, since all the necessary data are displayed on the display unit, the operator can easily identify and resume copying.

Depending upon the structure of the control device of the copying machine embodied by the present invention, a wide variety of advantages are possible as described below. In the event of any abnormal condition in the copying machine and the designated alarm display lighting up to indicate it, all other display units unnecessary for indicating the abnormal condition are simultaneously turned off by means designated for extinguishing such unnecessary display units. As a result, the operator can easily identify the illuminated alarm and immediately detect the location and content of the fault, thus making it possible for the operator to easily release the interrupted state. Furthermore, since the extinction of unnecessary display units draws the attention of the operator, copying during a machine malfunction can be avoided. While only certain embodiments of the present invention have been described, it will be apparent to those skilled in the art that various changes and modifications may be made therein without departing from the spirit and scope of the invention as claimed.

What is claimed is:

1. A display control device for a copying machine having a plurality of alarm displays on an operation panel of the copying machine for warning operators of some abnormal condition present within the copying machine, said display control device comprising:

means for illuminating an alarm display corresponding to the content of the abnormal condition present within said copying machine; and means for extinguishing all displays other than said alarm display.

2. The copying machine according to claim 1, further comprising, a plurality of operational modes corresponding to a plurality of functions performed by said copying machine, mode memory means for storing data to activate at least one of said plurality of operational modes.

3. The copying machine according to claim 2, wherein said mode memory means stores a plurality of signal codes each corresponding to a specific abnormal condition which may occur while one of said plurality of operational modes is in operation.

* * * * *